US008910549B2

(12) United States Patent
Grimm

(10) Patent No.: US 8,910,549 B2
(45) Date of Patent: Dec. 16, 2014

(54) METHOD AND DEVICE FOR PRODUCING PRECISION BLANKINGS FROM A MATERIAL STRIP

(75) Inventor: Willi Grimm, Kallnach (CH)

(73) Assignee: Feintool Industrial Property AG, Lyss (CH)

( * ) Notice: Subject to any disclaimer, the term of this patent is extended or adjusted under 35 U.S.C. 154(b) by 638 days.

(21) Appl. No.: 12/977,733

(22) Filed: Dec. 23, 2010

(65) Prior Publication Data

US 2011/0132162 A1 Jun. 9, 2011

Related U.S. Application Data

(63) Continuation of application No. PCT/EP2009/004364, filed on Jun. 17, 2009.

(30) Foreign Application Priority Data

Jul. 3, 2008 (EP) ..... 08012011

(51) Int. Cl.
*B26D 3/00* (2006.01)

(52) U.S. Cl.
USPC ..... 83/40; 83/55

(58) Field of Classification Search
USPC ..... 83/55, 621, 688, 39–41, 49, 50
See application file for complete search history.

(56) References Cited

U.S. PATENT DOCUMENTS 2,419,862 A * 4/1947 Wales ..... 83/23
3,232,156 A * 2/1966 Fuller ..... 83/39
3,583,266 A * 6/1971 Kondo ..... 83/51
3,712,163 A * 1/1973 Vinson ..... 83/206
3,724,305 A * 4/1973 Kondo ..... 83/14
3,878,746 A * 4/1975 Carmeli ..... 83/126
4,078,413 A * 3/1978 McCormick et al. ..... 72/343
4,141,264 A * 2/1979 Weisbeck ..... 83/23
4,362,078 A * 12/1982 Ohnishi et al. ..... 83/862

(Continued)

FOREIGN PATENT DOCUMENTS

DE 20 56 828 6/1971
DE 27 48 228 5/1979

(Continued)

OTHER PUBLICATIONS

International Search Report dated Aug. 31, 2009 for related PCT/EP2009/004364.

*Primary Examiner* — Sean Michalski
(74) *Attorney, Agent, or Firm* — Jordan and Hamburg LLP

(57) ABSTRACT

The incomplete compound die cut along the circumference of the precision blanking is performed with a specially shaped cutting edge of cutting punch (11) and/or the die plate (5) in such a way that the precision blanking (1) remains initially connected by a material bonding to at leas one partial connecting part on the material strip (2), either on the upper or lower plane at a level relative to the material strip. It is then moved together with the material strip in the running direction of the strip to a subsequent removal stage (ejector), in which the precision blanking and the material strip are separated from each other perpendicular to the running direction of the material strip towards the bottom by breaking out the connecting part without a vertical shear force component and without being pressed back, wherein the removed precision blanking (1) is discharged through a discharge chute (9) in the die plate.

16 Claims, 8 Drawing Sheets

(56) References Cited

U.S. PATENT DOCUMENTS

| | | | | |
|---|---|---|---|---|
| 4,477,537 | A * | 10/1984 | Blase et al. | 428/577 |
| 4,610,185 | A * | 9/1986 | France | 76/29 |
| 5,105,696 | A * | 4/1992 | Baubles | 83/35 |
| 5,163,223 | A * | 11/1992 | Wurster | 29/874 |
| 5,320,013 | A * | 6/1994 | Nonami et al. | 83/25 |
| 5,575,170 | A * | 11/1996 | Stodd | 72/336 |
| 5,881,611 | A * | 3/1999 | Wagner et al. | 79/1 |
| 5,983,761 | A * | 11/1999 | Sasaki et al. | 83/34 |
| 7,464,575 | B2 * | 12/2008 | Miyahara | 72/329 |
| 7,600,312 | B2 * | 10/2009 | Lee et al. | 29/738 |
| 8,196,498 | B2 * | 6/2012 | Wang | 83/49 |
| 2008/0016934 | A1 * | 1/2008 | Grimm et al. | 72/346 |
| 2008/0233804 | A2 * | 9/2008 | Froger et al. | 439/638 |
| 2010/0116014 | A1 * | 5/2010 | Goda et al. | 72/349 |
| 2012/0240389 | A1 * | 9/2012 | Usami | 29/598 |
| 2012/0283059 | A1 * | 11/2012 | Ando | 474/248 |

FOREIGN PATENT DOCUMENTS

| | | |
|---|---|---|
| DE | 10 2004 03282 | 2/2006 |
| JP | 11 309522 | 11/1999 |
| JP | 2002 035857 | 2/2002 |

* cited by examiner

METHOD AND DEVICE FOR PRODUCING PRECISION BLANKINGS FROM A MATERIAL STRIP

This application is a continuation application of pending PCT Application No. PCT/EP2009/004364, filed on Jun. 17, 2009, and published as WO 2010/000389 on Jan. 7, 2010, which claimed priority from EP Application No. 08012011.6, filed in Jul. 3, 2008, the entirety of which are each hereby incorporated by reference herein.

Method for producing precision blankings in a precision blanking die, wherein a material strip is clamped between two die halves comprising an upper and a lower die plate as well as an upper and a lower blanking punch; and the cutting operation in interaction with the upper and the lower blanking punch is performed as an incomplete compound die cut. In this case the precision blankings are removed from the die interior of the die in the running direction of the material strip.

Furthermore, the invention relates to a device that is intended for producing precision blankings from a material strip and that comprises at least one die plate and one blanking punch for cutting the precision blanking out of a material strip.

BACKGROUND ART

DE 10 2004 032 826 A1 discloses a method for producing stampings in a die, in particular in a precision blanking die, by means of at least one punch, with which the stamping is pressed out of a material strip. This known method provides that the stamping, after being pressed out of the material strip, is pushed by this strip to a discharge facility. In the course of pressing out the stamping, the punch works together with a pressure pad in a die plate. When the die is opened, the pressure pad pushes the stamping as far as to the surface of the die plate, and the material strip is lifted off the die plate. The material strip is lifted a defined distance off of the die plate, this distance being equal to at least the thickness of the stampings.

Although this strategy known from the prior art prevents the precision blanking from being pressed back into the material strip, a state that is considered to be a drawback for precision blankings, this advantage is achieved at the expensive of relative movements inside the die interior perpendicular to the running direction of the material strip, as a result of which it is necessary to completely open the die, and at the same time it makes the construction of the die more complicated. The complete opening of the die demands a longer opening path, as a result of which the number of press strokes is limited. Therefore, this method known from the prior art cannot be used with high speed presses.

Other known solutions discharge the stampings through sorting devices (see DE 27 48 228 A1) or by blowing them out. In some cases the stampings are pressed back again into the material strip and discharged with the material strip. However, this pressing back has the drawback that the high cutting quality achieved by the precision blanking operation is significantly reduced. The roughness of the clean cut functional surfaces and their range of tolerance requirement suffer from being pressed back contrary to the original cutting direction, and the pressing out causes the quality to suffer significantly.

JP 11309522 A discloses a method for punching out stampings from a board shaped strip material, wherein in a first cutting step the stamping remains connected along its periphery to the strip material, and in a second step the finishing cut of the semi-finished product is performed with the main punch.

Even in this prior art method the die has to be completely opened, a requirement that limits the number of press strokes and restricts its use to low speed presses.

Problem

Working on the basis of the aforementioned prior art, the object of the invention is to improve a method and a device for producing precision blankings in such a way that a vertical relative movement between the material strip and the precision blanking is completely avoided, the necessary opening and closing path of the device is reduced and the simple construction of the device makes it possible to use the device on high speed presses. At the same time the precision blankings do not suffer damage to the functional surfaces.

This engineering objective is achieved by a method of the aforementioned genre with the features of claim 1 and by a device with the features of claim 9.

Advantageous embodiments of the method and the device are apparent from the dependent claims.

The solution according to the invention is characterized in that the incomplete compound die cut along the circumference of the precision blanking is performed with a specially shaped cutting edge of the blanking punch and/or the die plate in such a way that the precision blanking remains initially connected by a material bonding to at least one partial connecting part on the material strip, either on the upper or the lower plane at a level relative to the material strip. It is then moved together with the material strip in the running direction of the strip to a subsequent removal stage (ejector), in which the precision blanking and the material strip are separated from each other perpendicular to the running direction of the material strip towards the bottom by breaking out the precision blanking without a vertical shear force component and without being pressed back, wherein the removed precision blanking is discharged through a discharge chute in the die plate.

According to the method of the invention, the precision blanking is cut completely out of the material strip to about 80 to 90% of its circumference. Only individual connecting regions or points remain between the precision blanking and the material strip. After the incomplete compound die cut, the precision blanking is held, in particular, by two or more connecting parts on the material strip. These connecting parts are arranged in such a way that when they are broken out at a later time, they do not come to rest in the area of the important functional surfaces of the precision blanking.

The connecting points between the material strip and the precision blanking are produced by the special shape of the cutting edges of the blanking punch and/or the die plates in connection with the kinematics of the precision blanking press that is used and that always moves into the same vertical position of the two relevant cutting edges independently of the variation in thickness of the material strip.

A die insert is inserted in a replaceable manner into a holder of the die plate, and a blanking punch with a partially formed bevel along its cutting edges is assigned to the die insert. This strategy has the unusual advantage that the die insert can be used over and over again by resharpening the front face. In this case the height loss or rather the material loss that the die insert suffers from the resharpening operation can be easily compensated by one or more shims that are inserted into the holder, a feature that is intrinsically advantageous from the point of view of enhancing the efficiency of the spare parts management.

The die insert is held in the holder so that it is uniformly prestressed along its circumference and projects beyond the base plate of the die plate in such a way that, on closing the device, the die insert can securely clamp point by point the material strip on the punch—that is, at predefined points—without the engagement of the base plate. In other words, the conventional method of clamping the material strip as a flat surface between the upper and the lower die half is avoided. This feature has the additional advantage that the precision blanking oil that is kept ready on the belt surface is not distributed unintentionally by the planar contact and is then no longer available in a sufficient amount for the cutting operation.

Furthermore, the concentration of the precision blanking-specific clamping forces on the die inserts has the advantage of assisting in generating clean cut parting planes on the precision blanking.

The spring force exerted on the precision blanking by an ejector guarantees that, on opening the die, the precision blanking and the material strip are held without tearing away.

Following removal, the precision blanking, which is separated from the material strip, is discharged perpendicular to the running direction of the material strip towards the bottom through a discharge chute in the die plate.

The device according to the invention is constructed in a simple and compact manner and has the major advantage that the necessary path for opening and closing the upper and the lower die half is significantly reduced. This objective is achieved by the fact that a holding space of the die plate has a die insert, which is held in a force-locking (non-positive locking) manner under uniform prestress. The die insert is assigned the blanking punch, wherein the cutting edges of the die insert and/or the blanking punch are provided with a partially formed bevel for incompletely cutting the precision blanking out of the material strip, and the die insert has relative to the die plate a vertical offset for partially clamping the material strip on the press or guide platen, in such a way that following the cutting operation, the precision blanking and the material strip are connected together by a material bonding by at least one partial connecting part, and that in the removal stage there is an ejector for breaking out the at least one partial connecting part from the material strip without transferring a vertical shear force component to the connecting part, and that the die plate has a discharge chute for removing the separated precision blanking towards the bottom in relation to the running direction of the material strip.

The special shape of the cutting edge of the die insert and/or the blanking punch consists of a partially formed bevel, of which the length and/width [sic] and/or the inclination can vary. This bevel correspondingly interrupts the cutting edge of the die insert and/or the blanking punch, so that the precision blanking is not completely cut out of the material strip and remains connected by a material bonding to the partial connecting parts on the material strip, either at its upper or its lower plane at a level relative to the material strip.

The free space that is required for conveying the composite comprising material strip and precision blanking inside the interior of the device is obtained by the fact that the die insert exhibits an offset relative to the die plate that is dimensioned in such a way that the space required for the precision blankings, which protrude downwards by an amount equal to the material thickness, but are still connected to the material strip, is guaranteed so that the precision blankings cannot be pressed back in the vertical direction nor can they be moved elsewhere.

When the material strip is clamped, the die inserts, which protrude relative to the die plate, also enable a concentration of the precision blanking-specific clamping forces around the cutting geometry, a feature that offers the advantage that the quality of the parting surfaces on the precision blanking can be enhanced.

The die insert can be replaced and can also be used over and over again after resharpening. The loss of height or rather material on the die insert due to resharpening can be compensated by shims of varying thickness that can be laid under the die insert in the holding space. Such a die insert makes it possible to keep a flexible and cost effective inventory of spare parts and extends the service life of the material of the die inserts.

Furthermore, there is the advantage that the lubricant that is supplied at the inlet on the belt surface and that is provided for the precision blanking operation is not completely pushed away when the material strip is clamped, because the material strip is clamped only at fixed points around the cutting geometry, and, hence, there is no need for a planar clamping of the material strip between the upper and the lower half of the device, as had been the practice to date.

The blanking punch is assigned an ejector, which is disposed in the press ram and is tensioned by a set of springs. On opening the die—that is, when the press ram returns—this ejector prevents, through relaxation of the set of springs, the at least one connecting part from tearing away from the material strip.

The method according to the invention and the device according to the invention are characterized by small opening and closing paths, so that high cycle rates and high discharge outputs can be obtained, and, as a result, it is possible to use high speed presses.

Additional advantages and details are disclosed in the following description with reference to the accompanying drawings.

EXEMPLARY EMBODIMENT

The invention is explained in detail below by means of one exemplary embodiment.

IN THE DRAWINGS

FIGS. 1*a* to 1*d* are simplified schematic representations of the working steps of the method according to the invention, FIG. 2 is a sectional view of the configuration of the connecting part between the precision blanking and the material strip, on the one hand, and the configuration of the die insert and the blanking punch, on the other hand, and FIG. 3 is a sectional view of the inventive device for preventing the connecting part from tearing away from the material strip.

The engineering object of the method according to the invention is to produce precision blankings 1 from a material strip 2, preferably locking parts for car seats. However, the method according to the invention is not restricted to such parts, and the parts can also exhibit other geometric shapes.

Figure 1A:
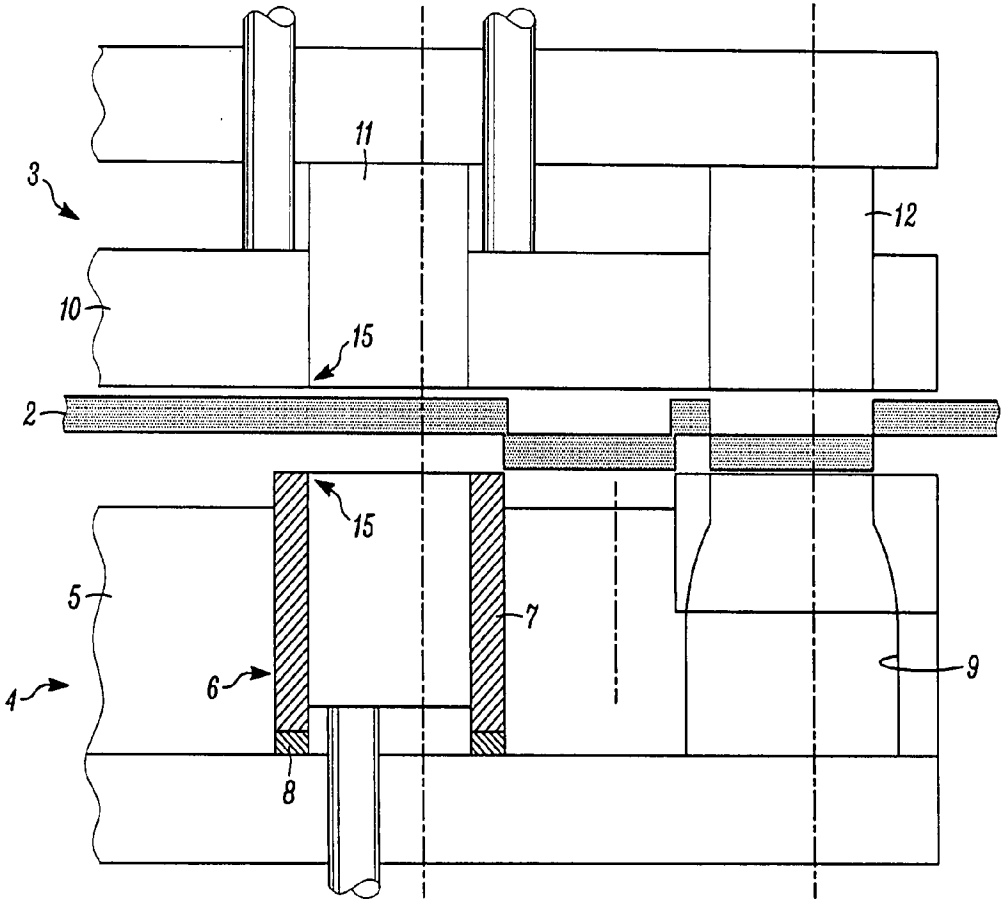

FIG. 1*a* shows the inventive device with an inserted material strip 2 in the open state of the upper die half 3 and the lower die half 4. The lower die half 4 includes a die plate 5, which has a holding space 6 for holding a die insert 7. In this case the die plate 5 lies fully on a base plate 8. In FIG. 1*a* the die insert 7 is shown as a tubular insert, but it can also exhibit other and more complicated shapes. On its periphery the die insert 7 is held under uniform prestress in the die plate 5 by, for example, a screw connection (not illustrated), so that the forces that are generated during the cutting operation can be safely absorbed by the die insert 7. As a result, the die insert 7 can be removed from the holding space 6 of the die plate 5 and, if desired, can be suitably resharpened. A shim 8, which is laid into the holding space 6 of the die plate 5, compensates for the loss in height of the die insert 7 due to the resharpening operation. To this end there is an inventory of shims 8 of varying thickness, so that it is possible to compensate for a variety of height losses as a function of the amount of resharpening, and the die insert 7 can regain the original height.

The die insert 7 exhibits a vertical offset H in relation to the die plate 5, so that the die insert 7 lies clearly above the level of the die plate 5. This vertical offset H is dimensioned in such a way that it is corresponds approximately to the material width of the material strip 2. The upper die half 3 and the lower die half 4 of the device according to the invention are opened so far that the material strip that is fed in has, together with the connected precision blanking 1, enough space in the running direction R of the material strip 2.

The lower die plate 5 has a discharge chute 9 that is arranged downstream of the die insert 7 and that is provided for discharging the precision blankings 1 towards the bottom approximately perpendicular to the running direction R of the material strip 2.

The die insert 7 is assigned a blanking punch 11 in the upper die half 3 for the purpose of cutting the precision blanking 1 out of the material strip 2, and the discharge chute 9 is assigned an ejector 12. The upper die half 3 has a press or guide platen 10, in which at least one blanking punch 11 and at least one ejector 12 are guided.

Figure 1B:
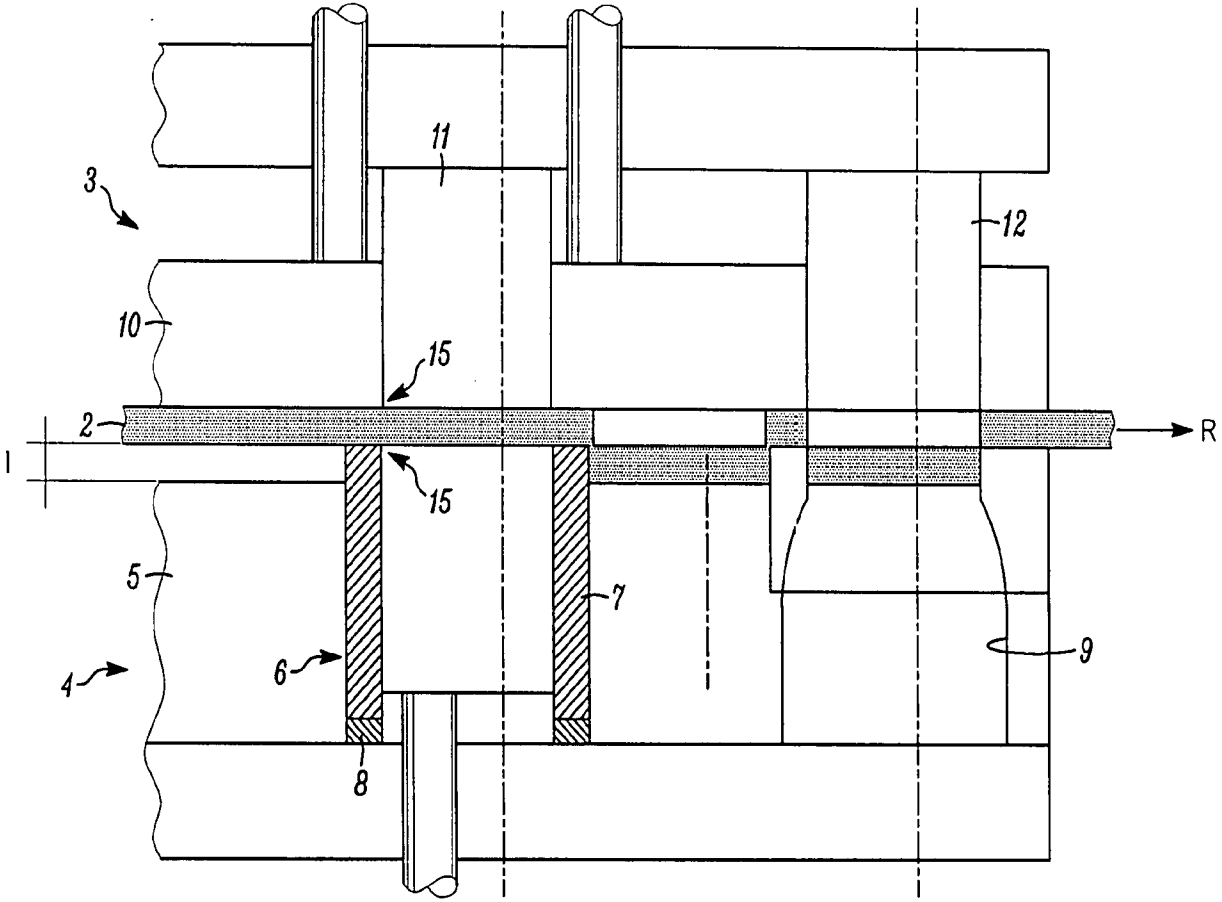

FIG. 1*b* shows the closed upper die half 3 and the closed lower die half 4 with the material strip 2 clamped between the die insert 7 and the guide platen 10. The clamping is carried out around the cutting geometry so that the precision blanking-specific clamping forces are concentrated on a narrow region. This feature assists in the production of clean cut parting planes on the precision blanking 1. Owing to the die insert 7 that is placed higher than the die plate 5, the lubricant pockets 13, disposed in the die plate, remain unaffected even in the clamped state of the material strip 2, thus making the supply of lubricant in the pockets available exclusively for the precision blanking operation.

Figure 1C:
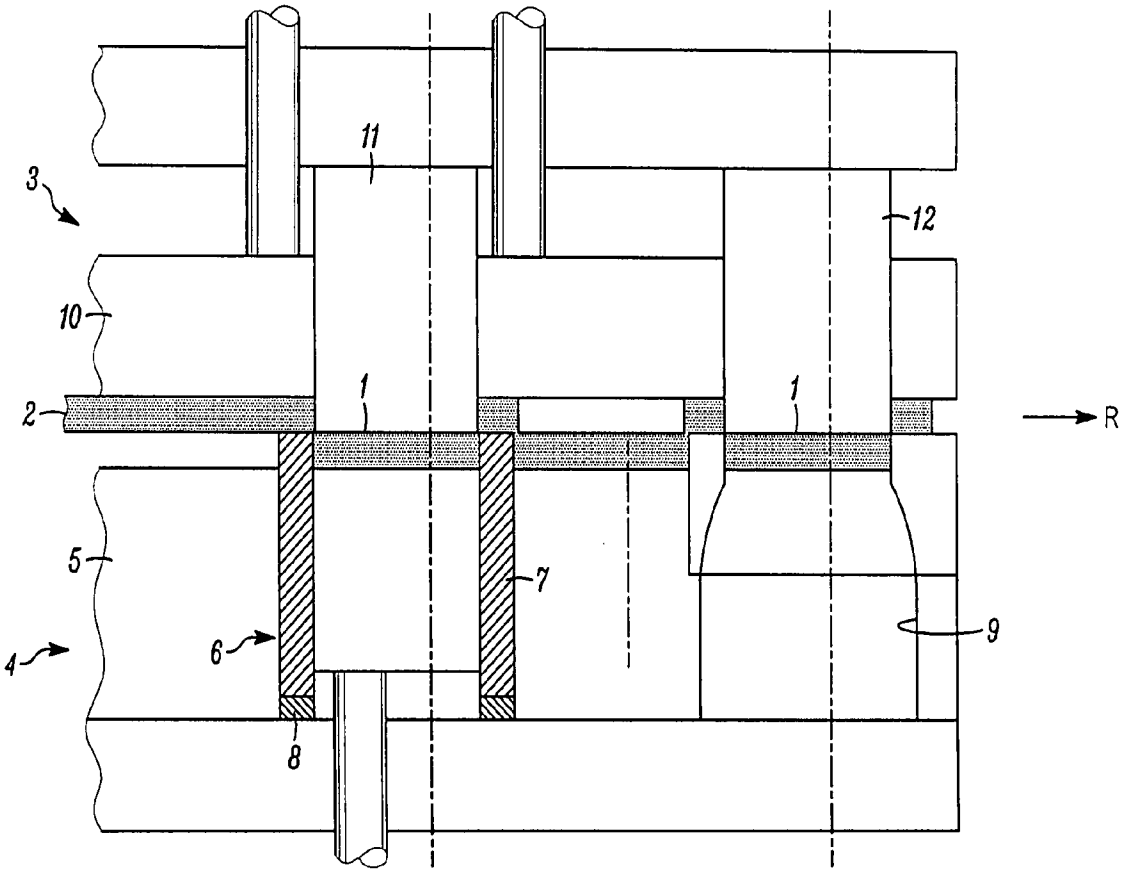
Figure 2:
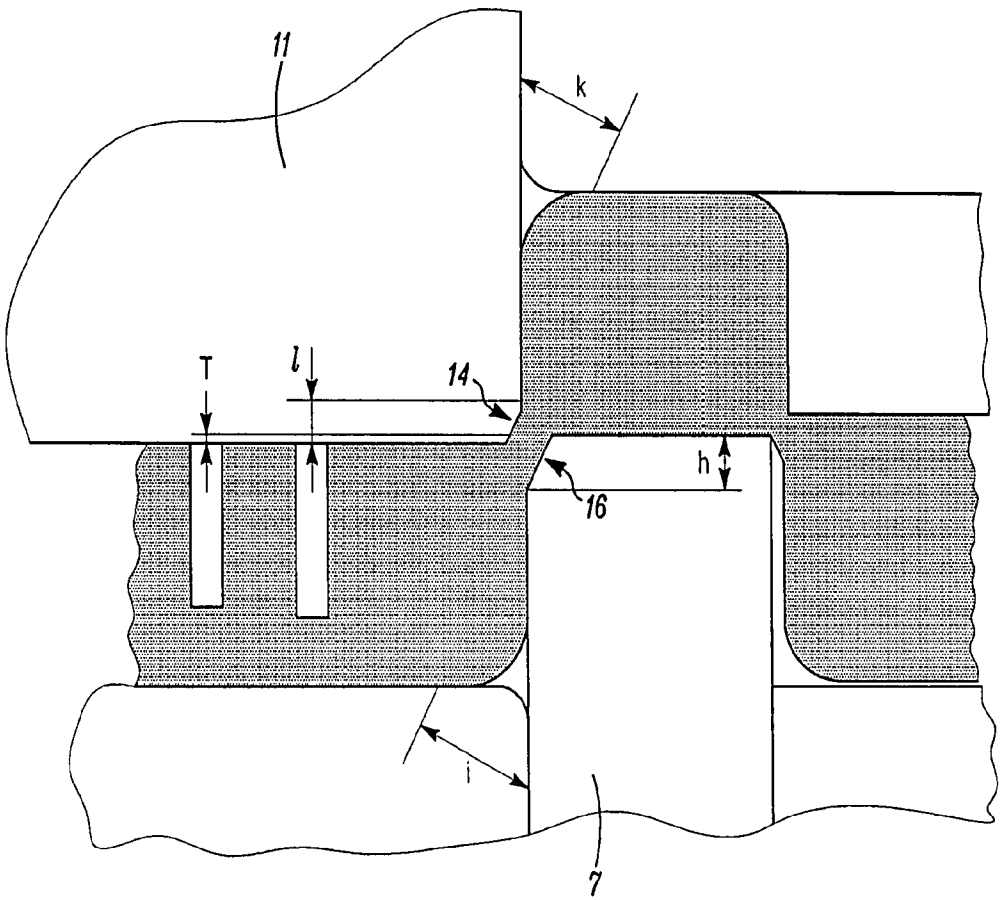

FIG. 1*c* shows the working step of the inventive method, wherein the blanking punch 5 has executed an incomplete compound die cut in the material strip 2, and the precision blanking 1 is cut out to about 80 to 90% of its circumference. At this point reference is made to FIG. 2, where following the cutting operation the precision blanking 1 remains connected by a material bonding to the material strip 2 at, for example, a narrow connecting part 14.

The incomplete compound die cut is achieved by a suitable preparation of the cutting edges 15 of the die insert 7 and/or the blanking punch 11 in connection with the kinematics of the precision blanking press that is used and that always moves into the same vertical position of the cutting edges of the die insert 7 and the blanking punch 11, independently of the variation in thickness of the material strip. The cutting edge 15 of the insert die 7 can be broken, for example, along its edge profile by one or more bevels 16. It is self-evident that the solution according to the invention includes the feature that the width and/or the length and/or the inclination of these bevels vary. This variation depends on the size, geometry and the distribution of the bevels over the die insert 7 and/or over the blanking punch 11 as well as on the thickness and quality of the material strip and on the allowable shape tolerances radially and axially at the connecting points of the precision blanking 1, all of which is elucidated by the dimensions h and i on the die insert 7 and the dimensions l and k on the blanking punch. This also applies to the cut-in depth T of the blanking punch 11 in the die insert 7.

Figure 1D:
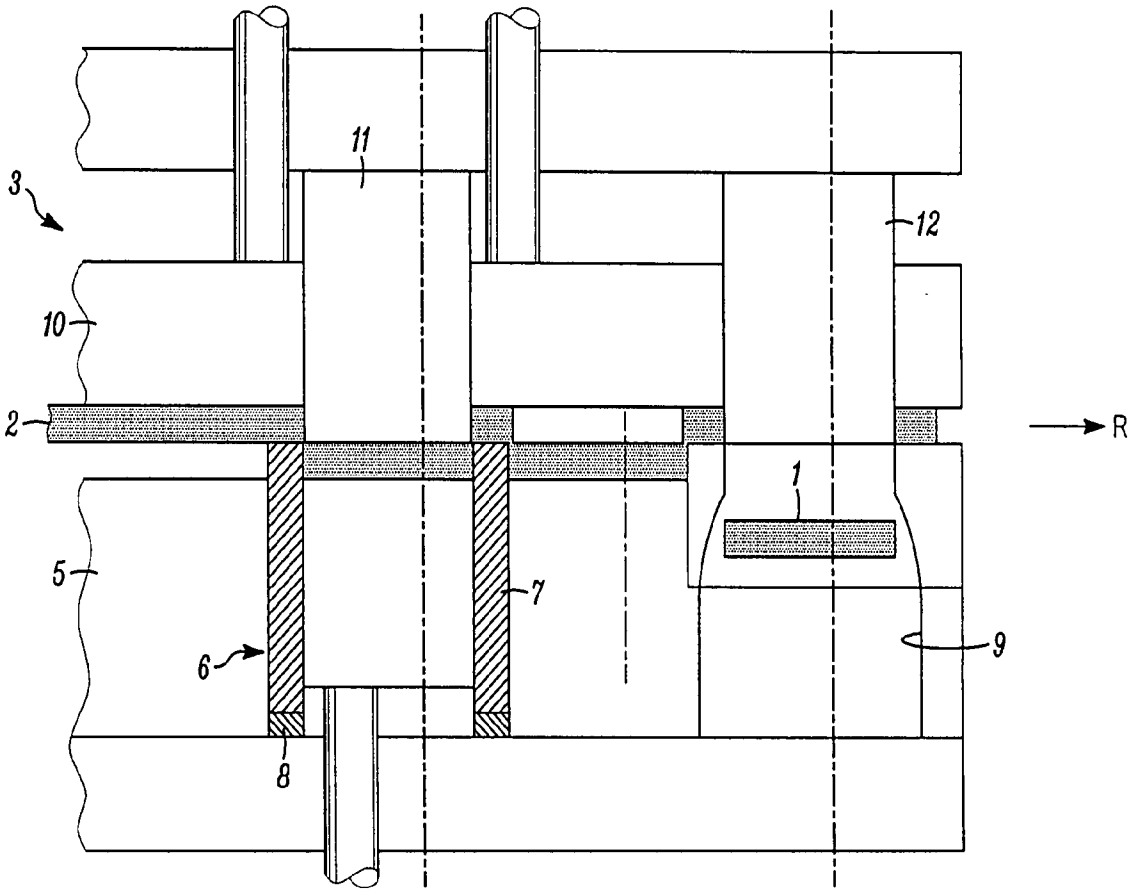

FIG. 1*d* shows that the ejector 12 of the removal stage has separated, without shear force, the connecting parts 14 between the precision blanking 1 and the material strip 2, and that the precision blanking 1 is discharged towards the bottom perpendicularly to the running direction R of the material strip 2 through the discharge chute 9. The connecting parts 14 are broken out largely without damage by the ejector 12. The connecting parts 14 are distributed over the circumference of the precision blanking 1 in such an advantageous way that these connecting parts do not lie on the functional surfaces of the precision blanking.

After the cutting operation, the material strip 1 forms with the connected precision blanking 1 a composite that can be conveyed in the running direction R as far as to the removal stage without any relative movement in the vertical direction when the device according to the invention is opened, because the die plate 5, which is placed lower than the die insert 7, provides sufficient space for the precision blankings 1 which protrude downwards by about the material thickness of the material strip 2. This feature is associated with the very important advantage that the necessary opening path in the device according to the invention can be maintained so small that the cycle rates can be significantly increased. This feature makes it possible to use high speed presses.

Figure 3:
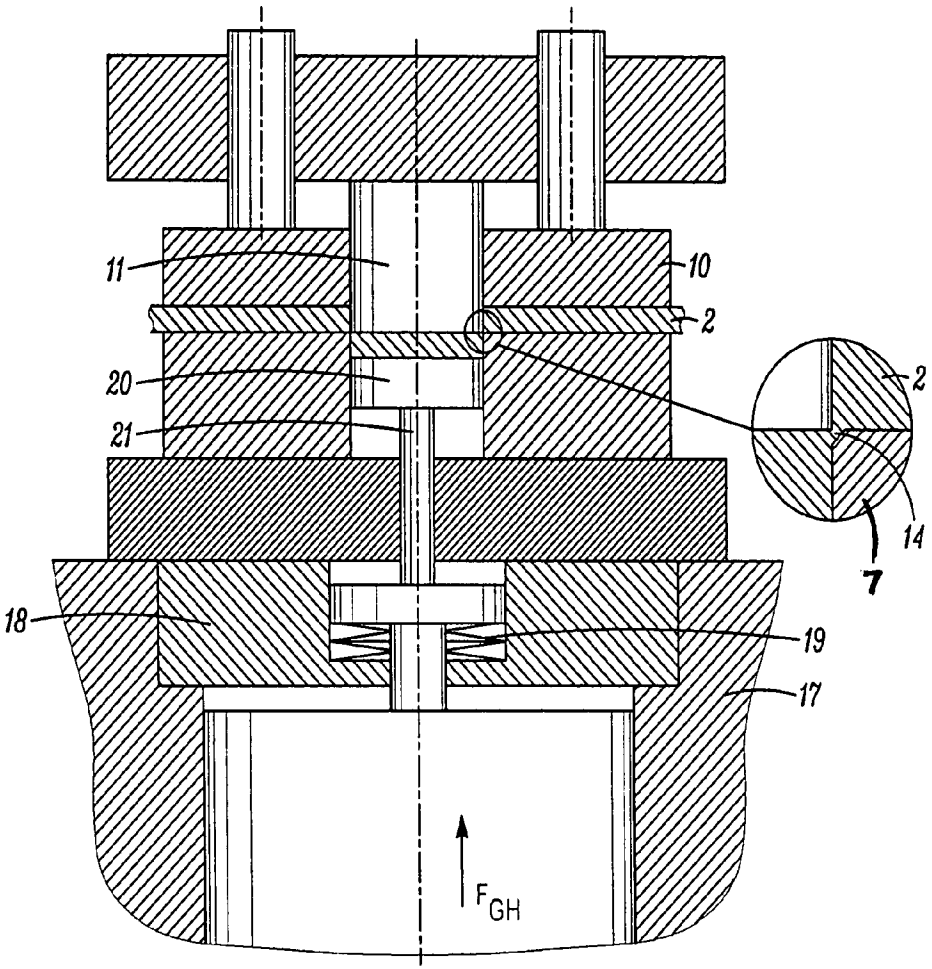
Figure 4:
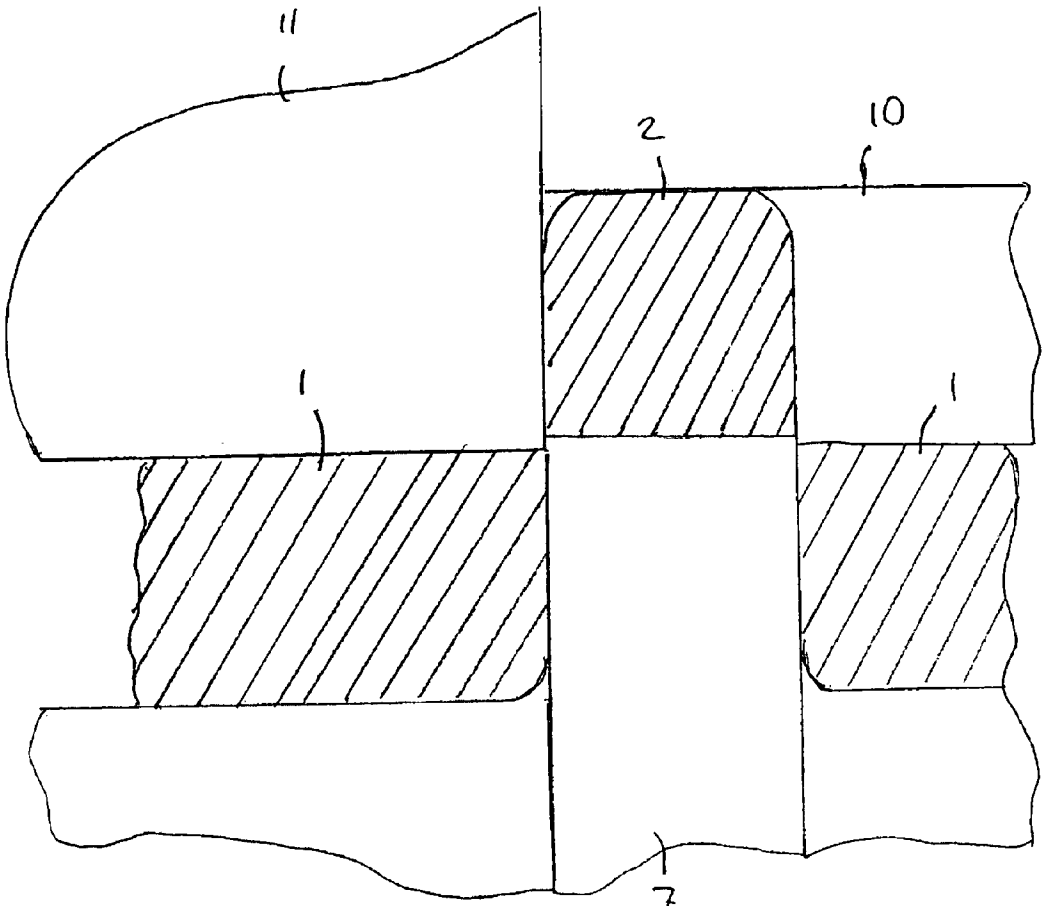
FIG. 4 is a sectional view of a completely cut through edge between the precision blanking and the material strip, and the configuration of the die insert and blanking punch.
Figure 5:
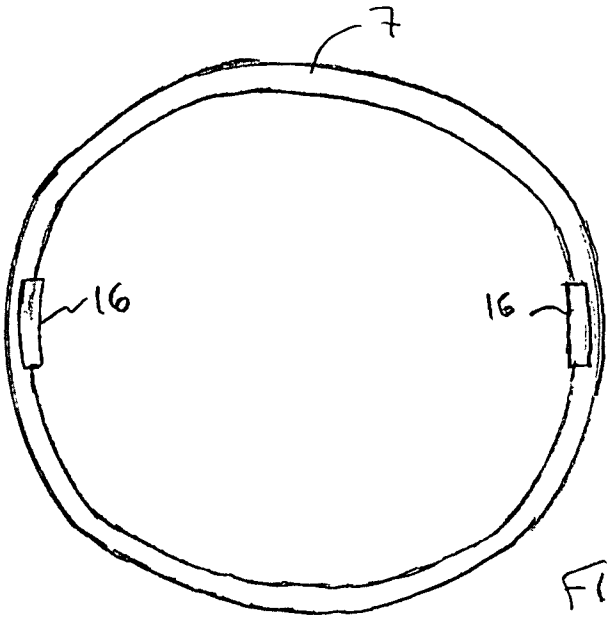
FIG. 5 is a diagram of specially formed cutting edge having bevels.

FIG. 3 shows a section of the inventive device for preventing the connecting parts 14 from tearing away from the material strip 2 and from pressing the precision blanking 1 back into the material strip 2 on opening the die, a feature that is especially advantageous for components having low ejector forces.

The blanking punch 11 is assigned an ejector 20, which is loaded with the force of the pressure pad FHG by way of the thrust bolt 21. The press ram 17 accommodates an insert ring 18, which has a set of springs 19 that act in the direction of the hydraulic pressure pad force FGH and, thus, assists this force. When the press ram returns—that is, when the die opens—the set of springs 19 can relax so that the connecting part 14 between the precision blanking 1 and the material strip 2 is intact—that is, can be removed from the die plate without tearing off. During this phase the blanking punch 11 and the guide platen 10 remain unchanged at their level, as a result of which the precision blanking 1 is prevented from pressing back into the material strip 2.

LIST OF REFERENCE NUMERALS AND LETTERS precision blanking 1
material strip 2
upper die half 3
lower die half 4
die plate 5
holding space in 5 6
die insert 7
shim 8
discharge chute 9
press or guide platen 10
blanking punch 11
ejector 12
lubricant pocket 13
connecting part 14
cutting edge 15 bevels 16
press ram 17
insert ring 18
set of springs 19
ejector 20
thrust bolt 21
force of the pressure pad $F_{GH}$
vertical offset H
cut-in depth T
running direction of the material strip 2 R
dimensions of the bevel 16 at 7 h, i
dimensions of the bevel 16 at 12 l, k

The invention claimed is:

1. A method for producing precision blankings in a precision blanking die, wherein a material strip is clamped between two die halves comprising an upper and a lower die plate as well as an upper and a lower blanking punch, and the cutting operation in interaction with the upper and the lower blanking punch is performed as an incomplete compound die cut, wherein the precision blankings are removed from the die interior of the die in the running direction of the material strip, the method comprising:

making an incomplete compound die cut in the material strip to define a cut periphery of the precision blanking wherein the material strip is completely cut through along one or more first partial lengths of the cut periphery and partially cut through without being completely cut through along one or more second partial lengths of the cut periphery so that the precision blanking remains connected to the material strip only at one or more connecting parts defined respectively by said one or more second partial lengths of the cut periphery at one of either an upper or lower surface of the material strip, wherein said incomplete compound die cut along the cut periphery of the precision blanking is performed with a specially shaped cutting edge among edges of said upper and lower blanking punch and said upper and lower die plate;

moving the precision blanking together with the material strip in the running direction of the strip to a subsequent removal stage;

separating the precision blanking and the material strip from each other perpendicular to the running direction of the material strip by breaking said one or more connecting parts without using a vertical shear force component by pressing only one of an upper and lower surface of the precision blanking; and discharging the removed precision blanking through a discharge chute in the die plate.

2. The method, of claim 1, wherein the precision blanking is cut completely out of the material strip incomplete compound die cut along 80to 90% of said cut periphery, said cut periphery being a circumferential periphery.

3. The method of claim 2, wherein after the incomplete compound die cut, the precision blanking is held by at least one or more parts on the material strip.

4. The method of claim 2, wherein a die insert, is inserted in a replaceable manner into a holder of the die plate, and cutting edges of a blanking punch, which is assigned to the die insert and which exhibits partially formed bevels along said cutting edges, are used as the specially shaped cutting edges.

5. The method of claim 2, wherein the die insert can be used repeatedly by resharpening at the front face, as a result of which loss of height or material that the die insert suffers from the resharpening operation is compensated by inserting one or more shims into the holder of the die plate.

6. The method, of claim 1, wherein upon completion of said incomplete compound die cut, the precision blanking is held by said one or more connecting parts.

7. The method, of claim 1, wherein a die insert, is inserted in a replaceable manner into a holder of the die plate, and cutting edges of a blanking punch, which is assigned to the die insert and which exhibits partially formed bevels along said cutting edges, are used as the specially shaped cutting edges.

8. The method, of claim 7, wherein the die insert can be used repeatedly by resharpening at the front face, as a result of which loss of height or material that the die insert suffers from the resharpening operation is compensated by inserting one or more shims into the holder of the die plate.

9. The method, of claim 1, characterized in that the die insert is uniformly prestressed along its circumference by a shape that is adapted to the geometry of the precision blanking.

10. The method, of claim 1, characterized in that the clamping of the material strip between the upper and the lower die half is performed only by the die insert.

11. The method, of claim 1, wherein on opening the die, the precision blanking and the material strip are held without tearing away by means of a spring force that is generated by an ejector opposing said one of said upper and lower blanking punch.

12. A device that is configured for producing precision blankings from a material strip, comprising:

at least one die plate and one blanking punch for cutting the precision blanking out of a material strip;

a die insert at a holding space of the die plate, which is held in a force locking manner under uniform prestress, wherein the die insert is assigned the blanking punch, wherein cutting edges of the die insert and/or the blanking punch are interrupted by a partially formed bevel for incompletely cutting through the material strip along a partial perimeter of the precision blanking, wherein a cutting edge adjacent the partially formed bevel is configured for completely cutting through the material strip;

wherein the die insert has relative to the die plate a vertical offset for partially clamping the material strip on a press or guide platen, such that following the cutting operation, the precision blanking and the material strip are connected together by a material bonding by at least one partial connecting part, wherein in the removal stage there is an ejector for breaking the at least one partial connecting part from the material strip without transferring a vertical shear force component to the connecting part, and wherein the die plate has a discharge chute for removing the separated precision blanking towards the bottom perpendicular to the running direction of the material strip.

13. The device, of claim 12, characterized in that the partially formed bevels (16) on the cutting edges exhibit one or more of a different length or a different width or a different inclination.

14. The device of claim 12, wherein the die insert is replaceable.

15. The device of claim 12, further comprising one or more shims arranged under the die insert in the holding space, said shims varying in thickness and being configured to compensate for the loss of height or material due to resharpening the die insert.

16. The device, of claim 12, characterized in that the blanking punch (11) has an ejector (20), which is disposed in the press ram (17) and is tensioned by a set of springs (19) and, on opening the die—that is, when the press ram (17) returns— prevents, through relaxation of the set of springs (19), the at least one connecting part (14) from tearing away from the material strip (2).

* * * * *